US006932747B2

(12) United States Patent
Herman

(10) Patent No.: US 6,932,747 B2
(45) Date of Patent: Aug. 23, 2005

(54) EXERCISE DEVICE

(75) Inventor: William P. Herman, Marblehead, MA (US)

(73) Assignee: HL China, Hu Ko Hsiang Hsin Chu Hsian (TW)

( * ) Notice: Subject to any disclaimer, the term of this patent is extended or adjusted under 35 U.S.C. 154(b) by 37 days.

(21) Appl. No.: 10/411,462

(22) Filed: Apr. 10, 2003

(65) Prior Publication Data

US 2003/0228962 A1 Dec. 11, 2003

Related U.S. Application Data

(60) Provisional application No. 60/371,563, filed on Apr. 10, 2002, and provisional application No. 60/396,158, filed on Jul. 16, 2002.

(51) Int. Cl.[7] ..... A63B 21/00
(52) U.S. Cl. ..... 482/126; 482/121; 482/127
(58) Field of Search ..... 482/122–125, 482/127, 126, 91, 121, 49, 112

(56) References Cited

U.S. PATENT DOCUMENTS 964,745 A * 7/1910 Blakoe
1,551,459 A 8/1925 Blakoe
2,188,114 A 1/1940 Schenk
2,590,951 A 4/1952 Farison
3,119,614 A 1/1964 Berry
5,334,122 A * 8/1994 Cole et al. ..... 482/130
5,342,273 A * 8/1994 Plendl et al. ..... 482/126
5,547,446 A 8/1996 Szabo
5,569,136 A * 10/1996 Holten ..... 482/126
5,807,217 A * 9/1998 Endelman ..... 482/122
6,648,804 B2 * 11/2003 Chen ..... 482/125

FOREIGN PATENT DOCUMENTS

WO WO 95/22376 8/1995
WO WO 99/04862 2/1999

* cited by examiner

*Primary Examiner*—Jerome W. Donnelly
(74) *Attorney, Agent, or Firm*—Eric Karich

(57) ABSTRACT

An exercise device has a pair of handle portions that are connected by a pair of connection portions to form an annular body. The pair of connection portions have a flattened cross-section that provides a rotation bias towards a rest configuration. The rotational bias of the pair of connection portions enables a twisting exercise that is useful for strengthening the hands and forearms of a user.

1 Claim, 2 Drawing Sheets

EXERCISE DEVICE

CROSS-REFERENCE TO RELATED APPLICATIONS

This application for a utility patent claims the benefit of U.S. Provisional Application No. 60/371,563 filed Apr. 10, 2002; and U.S. Provisional Application No. 60/396,158 filed Jul. 16, 2002. Each of these applications is incorporated herein by reference.

STATEMENT REGARDING FEDERALLY SPONSORED RESEARCH

Not Applicable

BACKGROUND OF THE INVENTION

1. Field of the Invention

This invention relates generally to exercise devices, and more particularly to an annular exercise device that enables a twisting exercise that is useful for strengthening the hands and forearms of a user.

2. Description of Related Art

The following art defines the present state of this field:

Schenk, U.S. Pat. No. 2,118,114, teaches an elastic cord exerciser. The exerciser includes a pair of handles attached to each other by an elastic band. Exercises are performed by pulling the handles apart against the resistance of the elastic band. Similar devices are taught in Farison, U.S. Pat. No. 2,590,951, Berry, U.S. Pat. No. 3,119,614, Szabo, U.S. Pat. No. 5,547,446, Plendl et al., U.S. Pat. No. 5,342,273, teaches an isokinetic exercise hoop. The hoop includes handles attached at diametrically opposing positions and is useful for compression and expansion exercises, not twisting exercises. A similar device is disclosed in Endelman, U.S. Pat. No. 5,807,217 (ring shaped exercise apparatus), Blakoe, U.S. Pat. No. 1,551,459 (exercising apparatus), and Sheppard, U.S. Pat. No. D344,995 (resilient exercise ring).

The above-described references are hereby incorporated by reference in full.

The prior art teaches various exercise rings for compression and expansion exercises. However, the prior art does not teach an exercise device that is adapted to enable the twisting exercises disclosed herein. The present invention fulfills these needs and provides further related advantages as described in the following summary.

SUMMARY OF THE INVENTION

The present invention teaches certain benefits in construction and use which give rise to the objectives described below.

The present invention provides an exercise device having a pair of handle portions that are connected by a pair of connection portions to form an annular body. The pair of connection portions have a flattened cross-section that provides a rotation bias towards a rest configuration. The rotational bias of the pair of connection portions enables a twisting exercise that is useful for strengthening the hands and forearms of a user.

A primary objective of the present invention is to provide a exercise device having advantages not taught by the prior art.

Another objective is to provide an exercise device that enables a twisting exercise that is useful for strengthening the hands and forearms of a user.

A further objective is to provide an exercise device that is small, lightweight, inexpensive, and easy to use.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, an exercise device 10 that enables a twisting exercise that is useful for strengthening the hands and forearms of a user.

Figure 1:
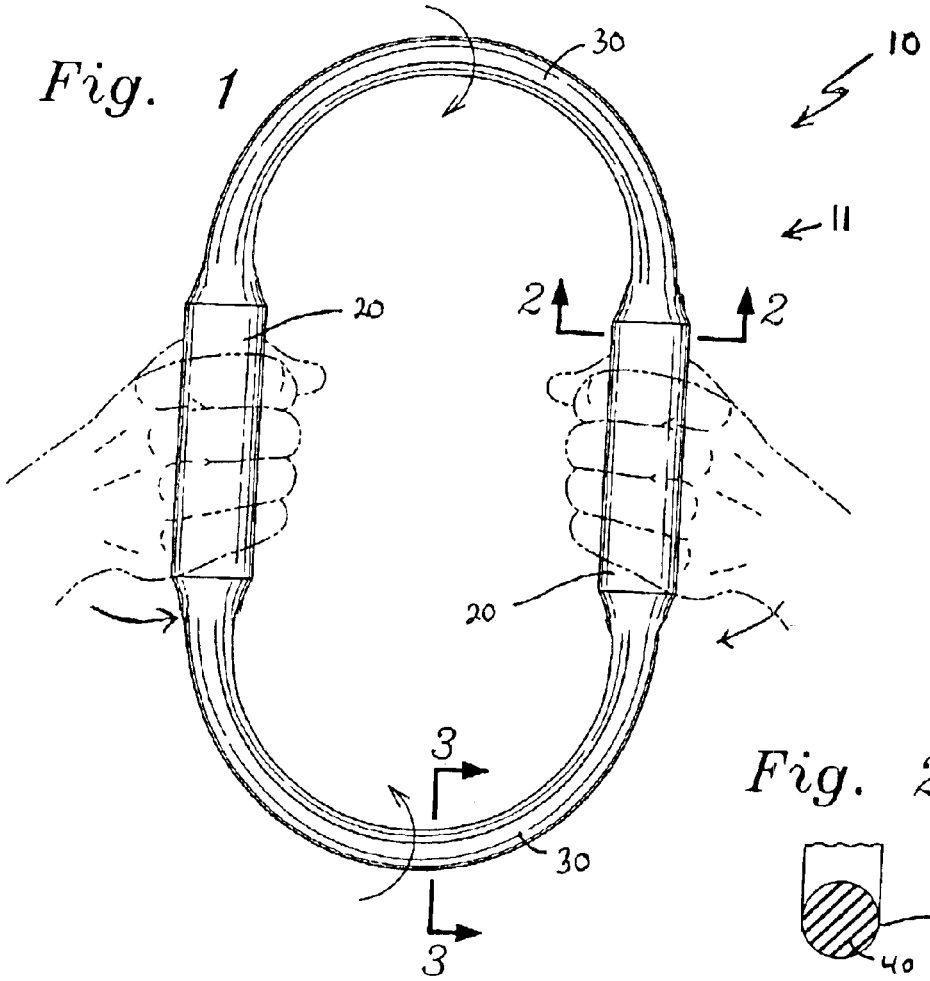
FIG. 1 is a perspective view of a first embodiment of the present invention, an exercise device.

As shown in FIG. 1, the exercise device 10 includes an annular body 11 that includes a pair of handle portions 20 and a pair of connection portions 30. For purposes of this application, the term "annular body" should be construed to include any generally round shapes, including shapes that are ovoid, polygonal, or any irregular shapes that provide the functional relationships described herein.

The exercise device 10 is constructed of a resilient material that is soft and flexible enough to enable the exercises described below, but hard enough to provide sufficient resistance for exercise purposes. In a first embodiment, as shown in FIG. 1, the exercise device 10 is constructed of a single, integral piece of polyurethane having a hardness of 75–90 durometer; however, this embodiment of the exercise device 10 may also be constructed of urethane, rubber, or similar polymer or plastic, or the exercise device 10 could be constructed of a resilient metal such as a tubular steel or similar construction. The specific characteristics of the material used to construct the exercise device 10 are discussed in greater detail below.

Figure 2:
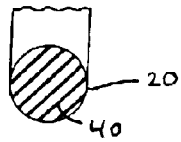
FIG. 2 is a sectional view thereof taken along line 2—2 in FIG. 1.

As shown in FIGS. 1 and 2, each of the pair of handle portions 20 has a cross-section that is suitable for gripping, preferably a cross-section that is generally round; however, the shape of the cross-section should not be limited thereto, but should include functionally equivalent shapes such as ovoid, octagonal, or similar geometric or irregular shapes that are generally round or otherwise suitable for gripping. Each of the pair of handle portions 20 may include a means for gripping, described in greater detail below.

Figure 3:
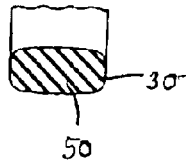
FIG. 3 is a sectional view thereof taken along line 3—3 in FIG. 1.

As shown in FIGS. 1 and 3, the connection portions 30 each have a generally flattened cross-section 50 with a rotational bias towards a rest configuration. For purposes of this application, the term generally flattened cross-section should be interpreted to include any shape having a greater width than height such that the rotational bias is generated. While the cross-section is preferably generally ovoid in shape, as shown in FIG. 3, other shapes that maintain the rotational bias are also suitable.

Figure 4:
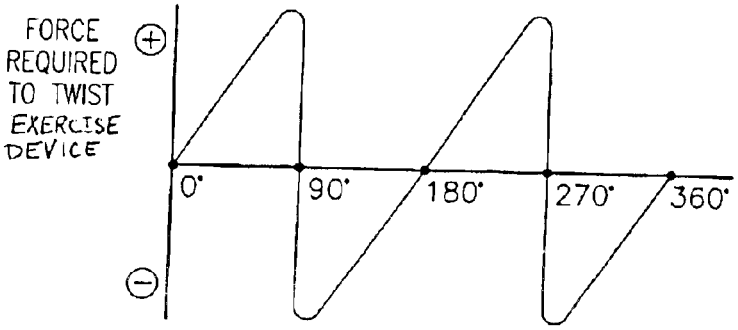
FIG. 4 is a graph illustrating the change in force required to twist the exercise device.

As shown in FIG. 4, the connection portions 30 provide a rotational bias towards the rest configuration. Twisting the connection portions 30 requires a force that varies with the shape and material of the exercise device 10, and with the degree of the twisting motion of the exercise device 10. It is the generally flattened cross-section 50 of the connection portions 30 that provides the rotational bias, which is a unique and critical characteristic. As the handle portions 20 are twisted up to ninety degrees, the force required to twist the handle portions 20 increases as the connection portions 30 are increasingly deformed. Once the user has twisted the exercise device 10 past ninety degrees, the natural resilience of the connection portions 30 reverses the force curve, and snaps the pair of handle portions 20 to the one-hundred and eighty degree mark. When the above-described steps are repeated, the same pattern is observed.

The exercise device 10 enables a twisting exercise that can be used to strengthen the hands and forearms of the user. The user grasps the exercise device 10 at each of the pair of handle portions 20, as shown in FIG. 1, and twists each of the pair of handle portions 20 either inwardly or outwardly, depending upon the muscles that the user desires to strengthen. As shown in FIG. 4, the resistance of the exercise device 10 to the twisting increases as the user twists the exercise device 10. The material and construction of the connection portions 30 must be selected to provide resistance characteristics that are suitable for the user. The resistance must be great enough to challenge the user, but not so great that the user cannot complete the entire twisting motion.

As described above, twisting the exercise device 10 beyond the ninety degree mark causes the exercise device 10 to snap to the one-hundred and eighty degree mark. At this point, the user shifts his or her grip on the exercise device 10 and again twists the device to the two-hundred and seventy degree mark, at which point the force curve again inverts and snaps the exercise device 10 back to its starting conformation. This enables the user to perform endless repetitions of the twisting exercise, thereby strengthening various parts of the user's upper body, particularly the hands and forearms.

Figure 5:
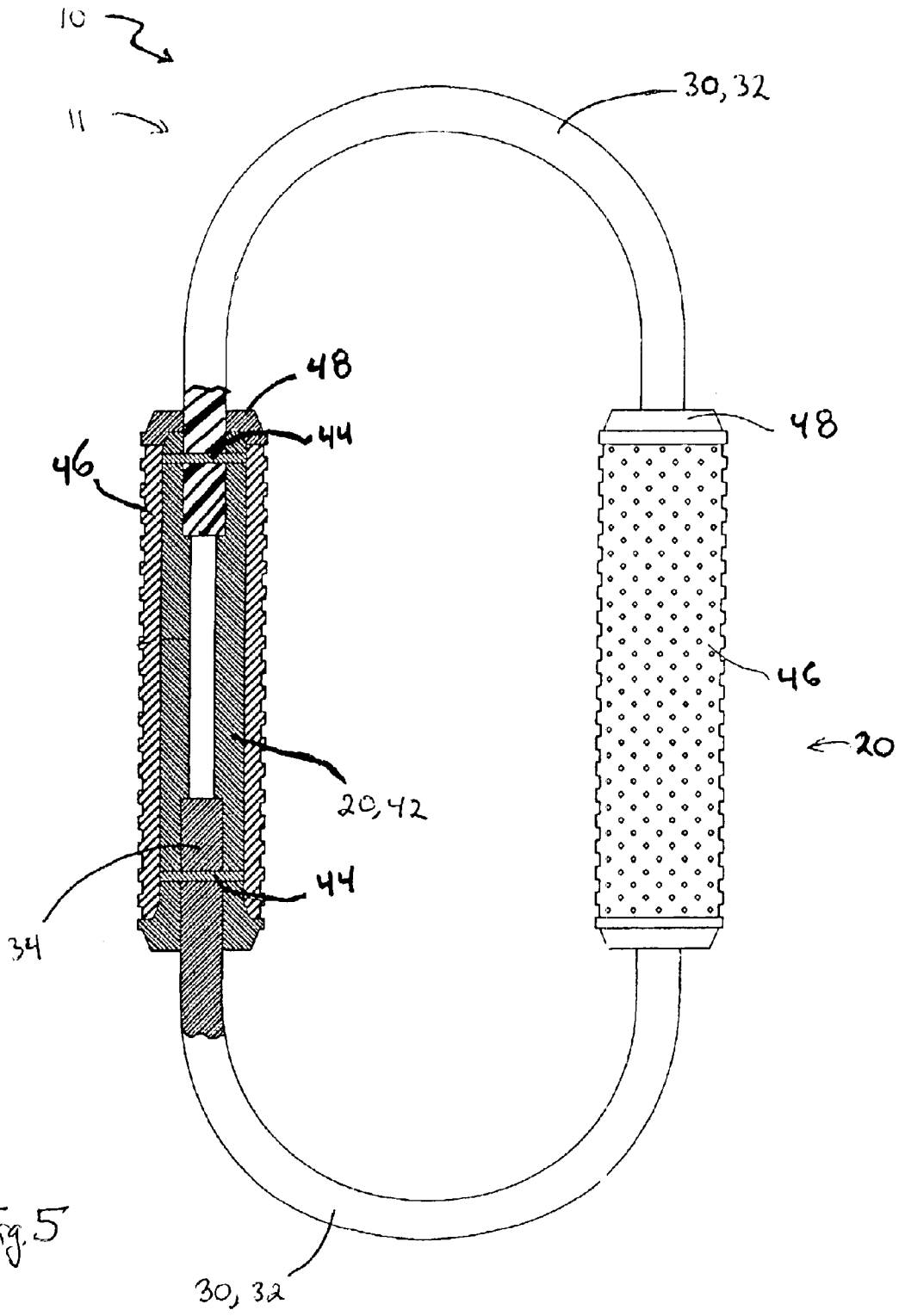
FIG. 5 is a top plan view of a second embodiment of the exercise device, a portion of the exercise device being shown in cross-section to illustrate the internal construction of the exercise device.

While the above-described structure represents one embodiment of the invention, the invention should not be limited to this single embodiment. In an alternative embodiment, as shown in FIG. 5, the pair of handle portions 20 (shown in FIG. 1) may be formed by a pair of tubular handles 42; and the connection portions 30 (shown in FIG. 1) may be formed from two generally C-shaped portions 32 having terminal ends 34. In this embodiment, the pair of tubular handles 42 are constructed of a generally rigid and durable material such as plastic, aluminum, or similar material; and the generally C-shaped portions 32 are constructed of a resilient material such as plastic or rubber. Each of the terminal ends 34 is adapted to be inserted into, or otherwise engaged with, one of a pair of tubular handles 42, to form the annular body 11.

In this embodiment, the exercise device 10 includes a means for connecting the pair of tubular handles 42 to the generally C-shaped portions 32 to form the annular body 11. In one embodiment, as shown in FIG. 5, the means for connecting is a pin 44 that is adapted to fit through both the tubular handle 42 and the terminal end 34 to secure them together. In alternative embodiments, now shown, the means for connecting may be provided by alternative connectors that are known in the art, including adhesives, welding, screws, or any form of connectors, fasteners, or engagements known in the art. It should be understood that any of the many fastening techniques well known in the art could be adapted to the present invention, and these alternatives should be considered within the scope of the claimed invention.

In one embodiment, shown in FIG. 5, the exercise device 10 further includes a means for gripping each of the pair of tubular handles 42. In this embodiment, the means for gripping includes a pair of grip sleeves 46. Each of the pair of grip sleeves 46 is positioned around one of the pair of tubular handles 42, and may also be used to cover the pins 44. The pair of grip sleeves 46 is constructed of a material that provides a high coefficient of friction to provide a good gripping surface, and may be constructed of rubber, a suitable plastic, a foam, or other suitable material.

In this embodiment, the exercise device 10 includes a means for securing each of the pair of grip sleeves 46 to one of the pair of tubular handles 42. In one embodiment, the means for securing includes a cap 48 that threadedly engages one of the pair of tubular handles 42 to secure the grip sleeve 46 on the tubular handle 42. The cap 48 has a diameter that is greater than the diameter of the grip sleeve 46, thereby functioning to hold the grip sleeve 46 in place. In an alternative embodiment, the means for securing may include an adhesive or other fastener to attach the grip sleeve 46 to, on, or around the tubular handle 42.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for exercising, the method comprising the steps of:

a) providing an exercise device that includes a pair of handle portions that are connected by a pair of connection portions to form a generally annular body, the connection portions each having a generally flattened cross-section that generates a rotational bias towards a rest configuration;

b) grasping each of the pair of handle portions of the exercise device; and c) twisting each of the pair of handle portions against the bias of the pair of connection portions more than ninety degrees, until the rotational bias causes the pair of handle portions to return to the rest configuration.

* * * * *